United States Patent [19]

Kubelka

[11] 4,133,119

[45] Jan. 9, 1979

[54] SKI BOOT

[75] Inventor: Axel R. Kubelka, Vienna, Austria

[73] Assignee: TMC Corporation, Zug, Switzerland

[21] Appl. No.: 770,586

[22] Filed: Feb. 22, 1977

[30] Foreign Application Priority Data

Feb. 25, 1976 [AT] Austria ..... 1410/76

[51] Int. Cl.[2] ..... A43B 5/04; B62B 0/00

[52] U.S. Cl. ..... 36/121; 280/613

[58] Field of Search ..... 36/121, 120, 117; 280/611, 613, 618

[56] References Cited

U.S. PATENT DOCUMENTS

| | | | |
|---|---|---|---|
| 3,854,743 | 12/1974 | Hansen | 36/121 |
| 3,870,325 | 3/1975 | Davis | 36/121 |
| 4,006,543 | 2/1977 | Post | 36/121 |
| 4,060,256 | 11/1977 | Collombin et al. | 36/121 X |

*Primary Examiner*—Patrick D. Lawson

*Attorney, Agent, or Firm*—Blanchard, Flynn, Thiel, Boutell & Tanis

[57] ABSTRACT

A ski boot having an ankle cuff which is movable relative to a lower shell about a transverse axis or the like which is provided at approximately ankle height on the ski boot. A support member is provided which cooperates with structure on the ski to limit the forward and/or the rearward movement of the ankle cuff relative to the lower shell. Generally, the support member cooperates between the ankle cuff and a component of the ski binding effecting securement of the ski boot to the ski. The components of the support member can be separate from the ski boot construction, namely part of the ski binding components or the support member can be an integral part of the ski boot construction having structure thereon which cooperates with an element fixedly secured to the ski.

15 Claims, 14 Drawing Figures

Fig. 1
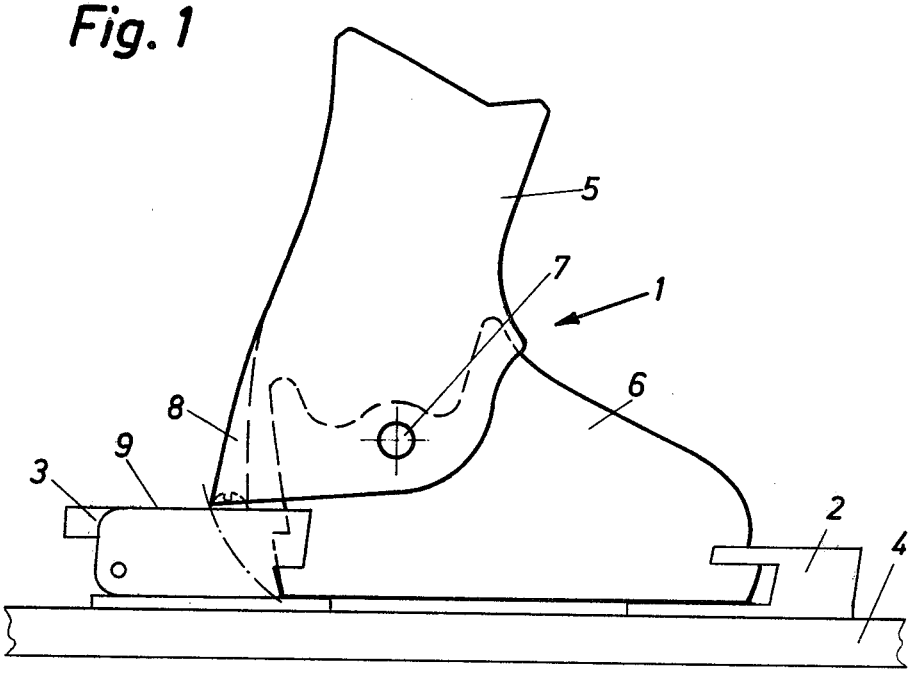
Fig. 2
Fig. 2a
Fig. 2b
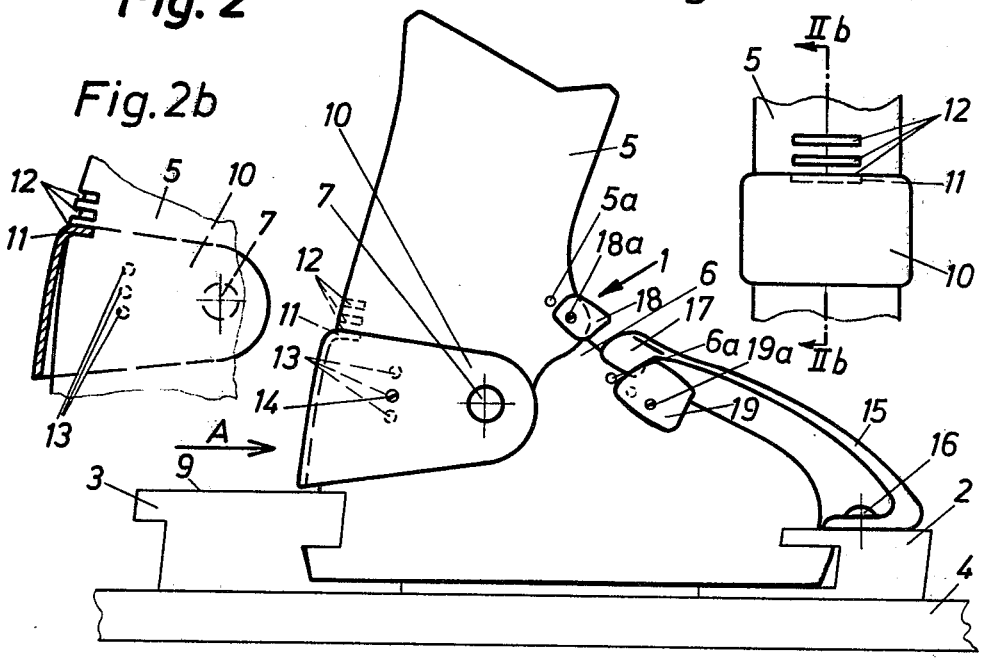

Fig. 3
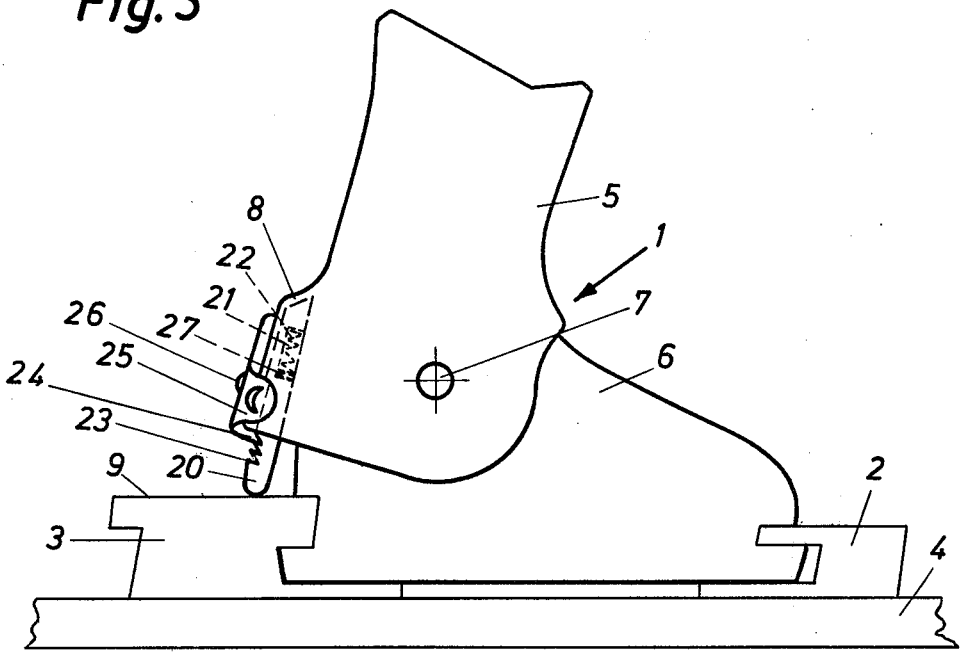
Fig. 4
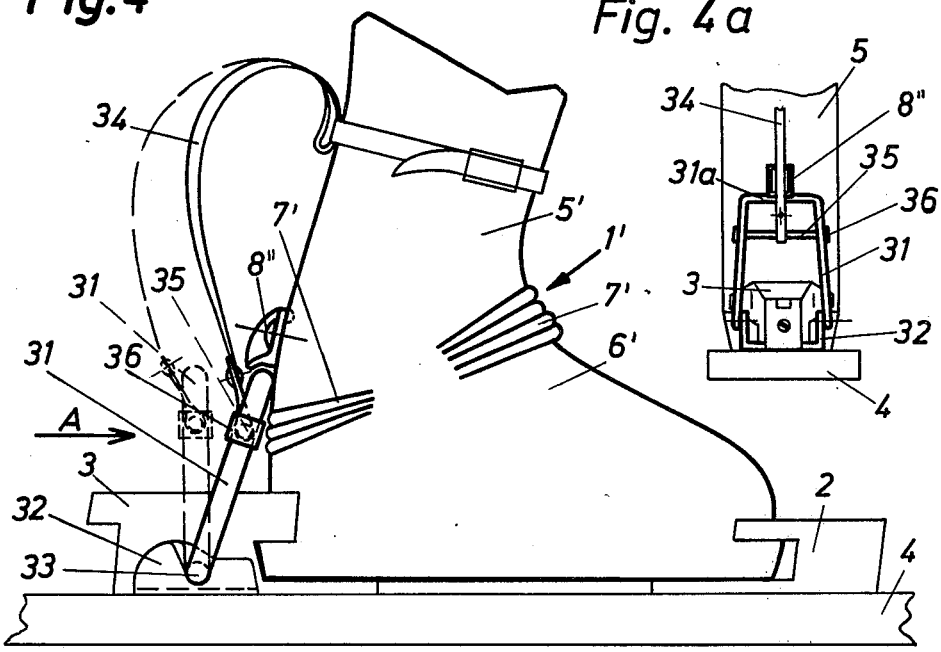
Fig. 4a

Fig. 3a
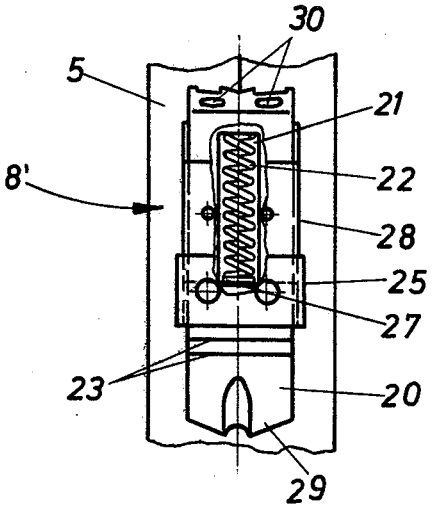
Fig. 3b
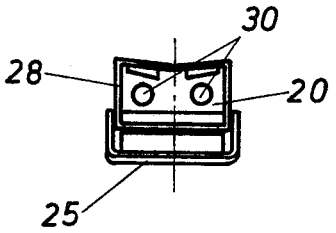
Fig. 7
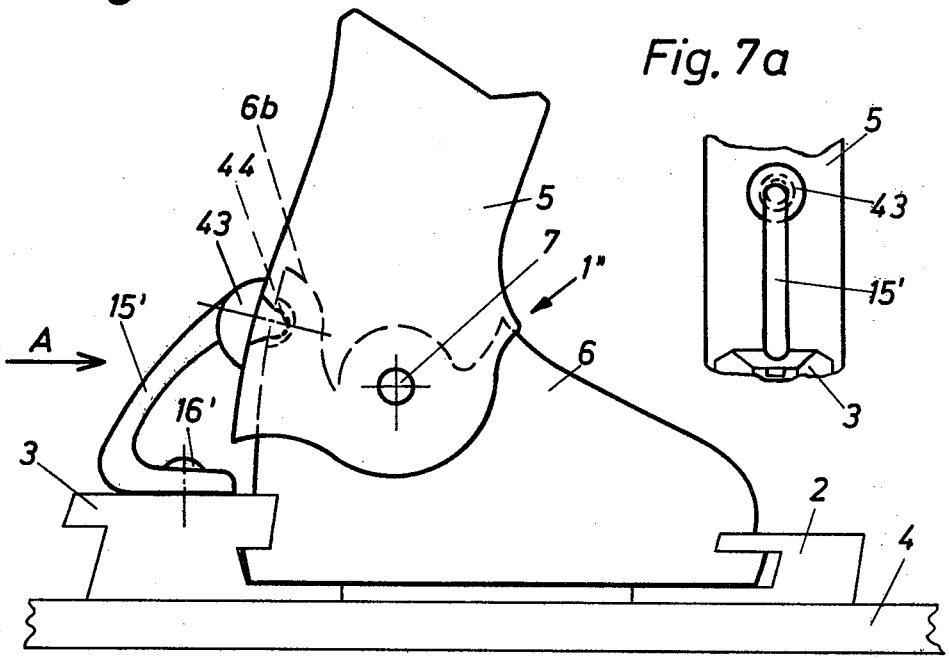
Fig. 7a

SKI BOOT

FIELD OF THE INVENTION

The invention relates to a ski boot in which the ankle cuff of the boot can be pivoted or moved relative to the lower shell of the boot about a transverse axis or the like located at approximately ankle height, wherein between the lower shell and the ankle cuff there is provided, if necessary, a connection which limits the relative position of the ankle cuff to the lower shell.

BACKGROUND OF THE INVENTION

A ski boot of the abovementioned type is described for example in Swiss Pat. No. 512,204 which corresponds to U.S. Pat. No. 3,686,778. The state of the art which is listed in this reference discusses a ski boot which has all of the above characteristics. However, ski boots are also known, in which only the absolutely necessary listed characteristics can be found.

The aforementioned reference describes a ski boot of the abovementioned type in which the connection is constructed as a support connection which fixes the ankle cuff of the boot in a selectable pivoted or moved position relative to the lower shell of the boot. Through this measure the forward position of the ankle cuff and the rear stop are adjusted individually to the desires of the skier.

Furthermore it is known from Swiss Pat. No. 518,071 to determine the relative position between the ankle cuff and the lower shell by means of a catch mechanism which is resiliently arranged at the rear part of the ski boot and can be inserted into one of the receiving holes which are arranged one behind the other and which extend substantially vertically. Through this the desired relative position is adjusted in steps.

Parallel to the arrangement of the receiving holes there is also provided a receiving opening having a longitudinal slot into which the catch mechanism can be introduced through lateral deviation. In this manner, it is possible by change-over to move the ski boot into a position suited for walking, wherein the path of swing of the ankle cuff is limited by the length of the slot.

The known constructions have the disadvantage that they are not suited for walking or walking is possible but only by complicated manipulations. A further, common disadvantage consists in the mentioned devices being complicated in relationship to the task to be solved.

The purpose of the invention is to overcome these disadvantages and to design a ski boot mentioned above so that the walking capability is assured without an additional operation.

The set purpose is achieved inventively by the upper part having at its rear area a projection, extension or the like, which in the downhill position rests directly or by the interpositioning of an adjustable support member on the associated ski binding part, or that the support member is secured on the ski or on a ski-fixed part.

The inventive construction of the ski boot produces a design which is suited both for walking without obstruction and with all necessary requirements for skiing. The ski boot includes an individual adjustment mechanism which automatically brings about the predetermined position of the boot during the closed position of the binding. A particularly advantageous embodiment is seen in a support being mounted between the ankle cuff and the lower shell also in the front area of the ski boot, which support determines the forward position and can be advantageously adjusted. This support can inventively consist of an extension which is secured on the front jaw and terminates in an inlay, which inlay can be inserted between two boot buckles which are provided on the ankle cuff or the lower shell of the ski boot.

BRIEF DESCRIPTION OF THE DRAWINGS

Further advantages and details of the invention will now be described more in detail with reference to the drawings which illustrate a number of exemplary embodiments.

In the drawings:

FIGS. 1 to 9 each illustrate a side view of the several exemplary embodiments of a ski boot embodying the invention;

FIG. 2*a* is a partial rear view of FIG. 2;

FIG. 2*b* is a fragmentary sectional view taken along the line II*b*—II*b* of FIG. 2*a;*

FIG. 3*a* is a partial rear view of FIG. 3;

FIG. 3*b* is a top view of FIG. 3*a;*

FIG. 4*a* is a partial rear view of FIG. 4; and

FIG. 7*a* is a partial rear view of FIG. 7.

DETAILED DESCRIPTION

Figure 5:
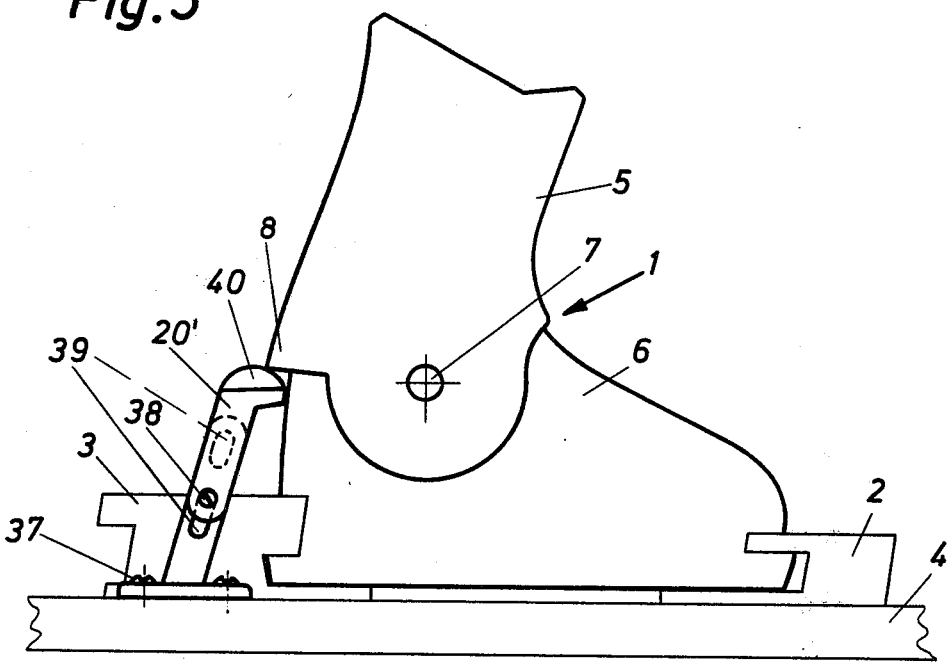

Generally, FIGS. 1 to 7 have in common a two-part ski boot 1 which is held on a ski 4 by means of two ski binding parts 2 and 3. The two-part ski boot 1 has in the exemplary embodiments of FIGS. 1 to 3, and 5 to 7 an upper part or ankle cuff 5 and a lower part or lower shell 6 which are pivotally connected by a transversely extending axle mechanism 7 which is positioned at ankle height on the ski boot. The embodiment according to FIG. 4 differs only in the ankle cuff 5' being connected to the lower shell 6' by means of a bellows 7', the action of which corresponds to the one of the transversely extending axle mechanisms 7. For this reason, the ski boot, which is illustrated in FIG. 4, is identified by the reference numeral 1'. A further modification is illustrated in the embodiment according to FIG. 7 wherein a support member 15' also engages the lower shell 6. The associated ski boot is identified by the reference numeral 1''.

Figure 8:
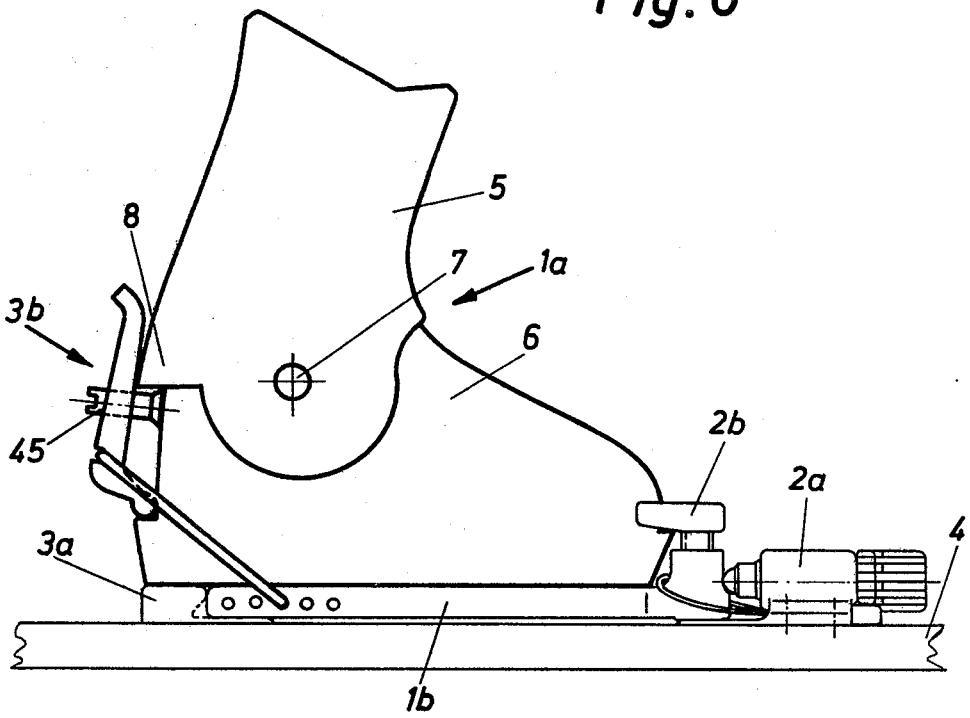
Figure 9:
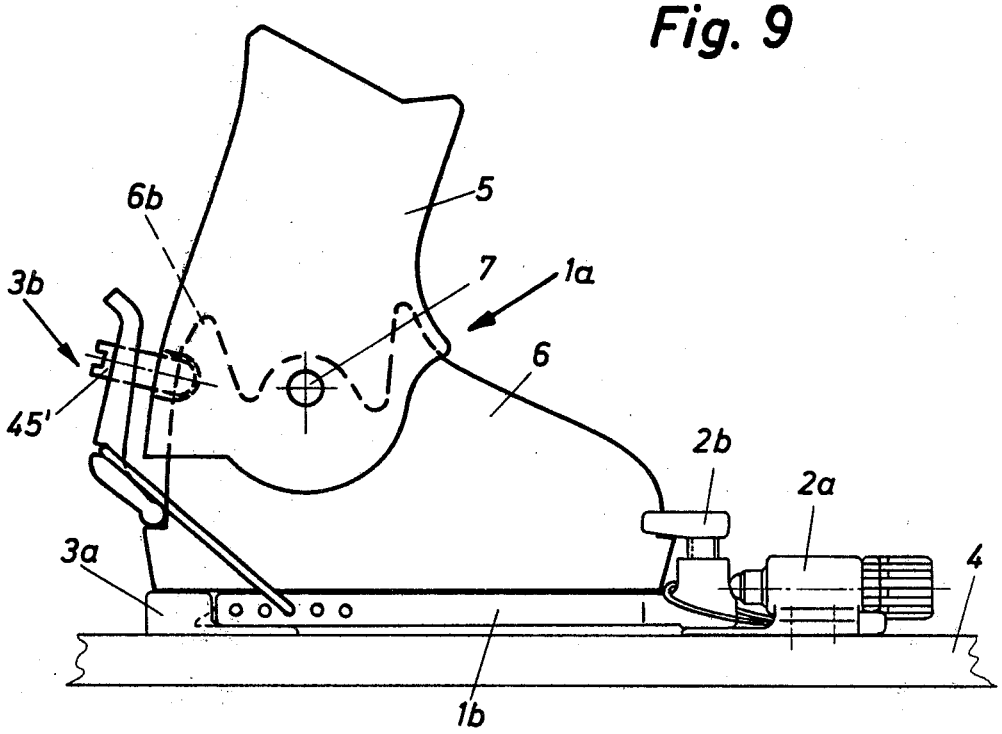

The exemplary embodiments according to FIGS. 8 and 9 illustrate a ski boot 1*a* which is held on the ski 4 by the interpositioning of a sole plate 1*b*. The sole plate 1*b* is, as is actually known, releasably held on the ski by ski binding elements 2*a* and 3*a* which, during a fall, assure the release of the ski boot 1*a* together with the sole plate 1*b*. Conventional holding elements 2*b* and 3*b* are provided for holding the ski boot 1*a* on the sole plate 1*b*. The support member 45' according to FIG. 9 engages, similar to the exemplary embodiment according to FIG. 7, the lower shell 6.

The abovediscussed exemplary embodiments will again be discussed hereinbelow discussing in more detail and without repeating the already discussed structure.

In the exemplary embodiment according to FIG. 1, the ankle cuff 5 has on its rearwardly facing side a projection, extension 8 or the like and the lower shell rests, in downhill skiing position, against the upper surface 9 of the rear binding part 3. In this exemplary embodiment, the lower rear edge of the ankle cuff 5 lies at the same height as the edge of the projection, extension 8; however, this measure is not a prerequisite. It would also be possible to provide a gradation between the two lower edges. As is illustrated by broken lines in FIG. 1, the projection, extension 8 or the like is able to fulfill an unhindered swing behind the heel of the boot 1c during walking.

In the exemplary embodiment according to FIG. 2, a reinforcing member 10 is mounted on the transversely extending axle mechanism 7 and has — as is better illustrated in FIGS. 2a and 2b — a reinforcing insert 11 thereon. The reinforcing insert 11 has an inverted L-profile, the longer arm of which extends substantially vertically and the shorter arm of which extends substantially horizontally. The ankle cuff 5 has a plurality of vertically spaced recesses 12 therein. The shorter arm of the reinforcing insert is received in one of the recesses 12. Threaded holes 13 are provided in the reinforcing member 10 and are adpated to receive a fixing screw 14 therein, which fixing screw can be screwed into an aligned hole which is provided in the ankle cuff 5. It can easily be recognized with reference to FIGS. 2, 2a and 2b that the respective position of the reinforcing member 10 determines the rearward position of the ankle cuff 5 in relationship to the lower shell 6 due to the lower edge of the reinforcing member 10 resting on or engaging the upper surface 9 of the ski binding part 3.

A support member 15 is mounted on the front ski binding part 2 in FIG. 2 to adjustably limit the forward position of the ankle cuff 5 in relationship to the lower shell 6. The support member 15 is secured by means of a screw 16 to the upper surface of the ski binding part 2 and terminates at its free end in an insert portion 17 which is inserted between two boot buckles 18 and 19, one of which is provided on the ankle cuff 5 and the other on the lower shell 6. The boot buckles 18 or 19 can be adjusted on the associated parts 5 or 6 in different positions by means of screws 18a or 19a which can be screwed into receiving bores 5a and 6a on the ankle cuff 5 and lower shell 6, respectively. The forward position of the ankle cuff 5 is thereby adjustably limited.

In the exemplary embodiment according to FIG. 3, a support member 20 is vertically adjustably mounted on the rear side of the ankle cuff 5 and is guided in a projection, extension 8 or the like on the ankle cuff. The support member 20 has a square-shaped recess 21 therein and has a pressure spring 22 mounted therein. The support member 20 has saw-toothlike teeth 23 on the rearwardly facing side thereof. A tongue 24 of a catch mechanism 25 is received between two of the teeth 23. The catch mechanism 25 is secured on the projection, extension 8 by means of rivets. The lower end of the spring 22 is supported on a foot 27 connected to the projection, extension 8 and projects inwardly in the recess 21.

A rear view of a modified support member 20 according to FIG. 3 is shown in FIG. 3a and includes a separate projection 8' forming a housing 28 which is secured to the ankle cuff 5. The foot 27 is formed of the material of the housing 28 and simultaneously functions as an outer guide for the support member 20. From FIG. 3a it can further be recognized that the support member 20 terminates in two prongs 29 which, as shown in FIG. 3, in turn engage the surface 9 of the ski binding part 3. As is shown in FIG. 3b, the support member 20 has at the upper end thereof two recesses 30 therein for the ski pole tip which, after the user steps into the binding, the rearward position of the ski boot can be adjusted to the desired position. To change the adjusted position, only the catch mechanism 25 need be pivoted or turned in clockwise direction (in the illustraded position of the ski boot), after which the support member 20 is automatically adjusted or moved into an elevated position by the pressure spring 22 so that the ankle cuff on the ski boot can assume any desired reset position within the limits of the original construction thereof. The notches which are also illustrated in FIG. 3b and are not identified in any detail permit a better adjustment of the support member 20 to the outside surface of the ankle cuff 5.

The exemplary embodiment according to FIG. 4 illustrates, as mentioned above, a ski boot 1', which has a bellows 7' for accommodating the intended forward movement of the ankle cuff. To secure or limit the rearward movement, a projection 8'' is fixedly secured to the ankle cuff 5' and serves as a stop. A U-shaped bar 31 is pivotally secured to a plate or bracket 32 and engages the projection 8''. The plate 32 is, as shown particularly in FIG. 4a, held on the ski by the ski binding part 3. The two legs of the U-shaped bar 31 are hingedly connected to the plate on opposite sides of the ski binding part 3. The free ends of each leg of the bar 31 has inwardly projecting pin parts 33 which are received in openings in the plate and/or the side of the ski binding part 3 and serve as pivot axes. The plate 32 also functions to limit the rearward movement of the bar 31.

The embodiment of FIG. 4 additionally shows how the bar 31 can be used at the same time to hold a conventional safety strap 34 which does not form the subject matter of the present invention. A transversely extending pin 35 is arranged adjacent the upper area of the bar 31 and is held on the bar on both sides by means of one hollow-type rivet 36. FIG. 4 illustrates in full lines the limited rearward position of the ankle cuff since the upper crossbar 31a portion of the bar 31 engages the projection 8'' and the lower area of the projection 8'' grips behind the crossbar 31a. A pivoted position of the bar 31 is shown in broken lines by which, at the rearward position of the ski boot 1' is limited only because of the structure thereof.

In the exemplary embodiment according to FIG. 5, a support member 20' is secured directly to the ski 4 by means of clamping screws 37. However, a modification is also possible in which the support member 20' is secured together with the ski binding part 3 directly or by the interpositioning of a washer to the ski. To adjust the desired rearward position, the support member 20' consists of two parts which can be fixedly connected to one another by means of a setscrew 38. One part has at least one, in the present exemplary embodiment two, longitudinal slots 39. To use one of the longitudinal slots 39 serves the rougher selection of the rearward position and a fine adjustment can take place within the longitudinal slots 39. The support member 20' has at the upper part a covering 40 consisting of an elastic material. Impacts, which are created during the skiing, are absorbed by this material. Parts of the support member 20' may have guideways or support surfaces (not shown) against unintended tilting.

Figure 6:
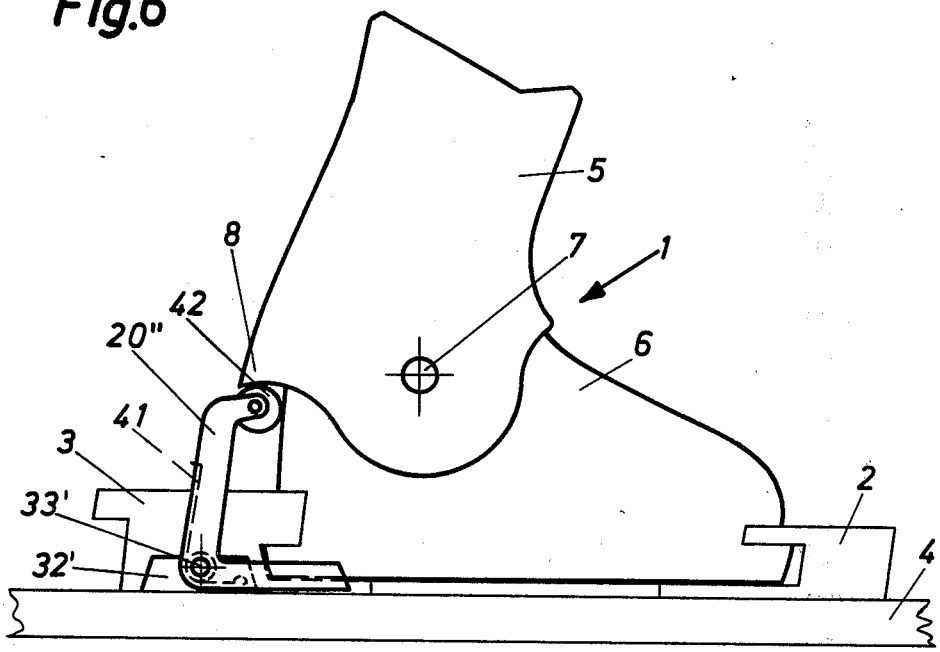

The exemplary embodiment according to FIG. 6 shows a support member 20'', which — similar to the bar 31 in FIG. 4 — is held pivotally in a plate 32' by means of pins 33' which serve as a pivot axis. The support member 20'' is held in the illustrated locking position by a torsion spring 41. A roller 42 is provided at the upper free end of the support member 20'' and is used for an easier engagement, however, it can also be used, if it is made of an elastic material, to absorb impacts during skiing.

To be complete, it is remarked that both the embodiment according to FIG. 5 and also the embodiment according to FIG. 6 have a similar symmetric design, as shown in FIG. 4a.

In the exemplary embodiment according to FIGS. 7 and 7a, a similar support member 15' is secured to the rear ski binding part 3 by means of a screw 16', as was shown in the exemplary embodiment according to FIG. 2 for the forward position limiter with the difference being that the free end of the support member 15' has a support head 43 with a snap part 44 engaging the lower part 6b of the inner part of the lower shell 6.

In the exemplary embodiments according to FIGS. 8 and 9, a conventional screw 45, 45' is used as a support member limiting the rearward position. The screw 45 is mounted on a tensioning device of a conventional type, which tensioning device serves as a holding part 3b. In the exemplary embodiment according to FIG. 8, the screw 45 is supported only on the lower shell 6. In order to alter the connection between the ankle cuff 5 and the screw which serves as a support member, the screw 45' is in the exemplary embodiment according to FIG. 9 — similar to FIG. 7 — also in engagement with the inner part of the boot 6b.

The invention is not limited to the listed exemplary embodiments. Various modifications are possible, without departing from the scope of the invention. In particular, variations of the individual constructions among one another are conceivable.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. The combination of a ski boot and a ski binding for releasably securing said boot to a ski, said ski boot having a lower shell with a raised rear wall and an ankle cuff pivotally secured to said lower shell to allow pivotal movement of said ankle cuff about a pivot axis in response to shifts in the weight of an individual using said ski boot, said ski binding including at least a heel holder fixedly secured to said ski and engaging the heel portion of said ski boot to hold said heel portion to a ski, wherein said ankle cuff has projection means extending rearwardly therefrom and includes first means thereon defining a downwardly facing first surface and wherein said heel holder is wholly separate from said ski boot and includes second means defining an upwardly facing second surface, said first surface directly engaging said second surface to limit the amount of pivotal movement of said ankle cuff to the rear of said lower shell.

2. The improved combination according to claim 1, wherein said second surface is located at a fixed height above the upper surface of said ski, and wherein said heel portion of said ski boot has a design which permits, when the boot is used for walking, said projection means to move unhindered and limited only by the original design of the pivoting capability of said ankle cuff.

3. The improved combination according to claim 1, wherein said ankle cuff has a plurality of vertically spaced recesses along the rearwardly facing side thereof, wherein said projection means comprises a reinforcing member pivotally secured to said pivot axis and being pivotal independently of said ankle cuff, said reinforcing member including a reinforcing insert which, in cross section, has an approximately inverted L-shape, the longer arm of which forms the rearward inner part of said reinforcing member, and the shorter arm of which is received into one of said recesses to fix the position of said reinforcing member relative to said ankle cuff.

4. The improved combination according to claim 3, including fastener means for additionally fixing said reinforcing member relative to said ankle cuff; and wherein said second surface is a surface on said heel holder.

5. The improved combination according to claim 1, wherein said projection means defines a hollow housing having a polygon-shaped recess therein, wherein said first surface is provided on a support member movable in said housing against the force of a spring, said spring being located in said housing so that one of its ends engages said support member and the other end engages the bottom of said recess, and wherein said support member has along the rear side thereof saw-toothlike teeth, said housing having a catch mechanism engaged with selected teeth to fix the position thereof relative to said housing.

6. The improved combination according to claim 15, wherein said projection means includes a fixed stop secured to said ankle cuff and, in the downhill position, engaging a bar pivotally secured to a plate held fixedly on said ski by said heel holder, said first surface being on said fixed stop, said second surface being on said bar.

7. The improved combination according to claim 1, wherein said second means includes a support member consisting of two elongated parts movable lengthwise relative to one another and means for securing said parts in different positions to vary the spacing of said second surface from said ski.

8. The improved combination according to claim 7, wherein said second surface on said support member has a coating of elastic material thereon.

9. The improved combination according to claim 1, wherein said ankle cuff has an opening therein, wherein said second means includes a support member and wherein said support member is secured to said heel holder and has a support head thereon extending through said opening in said ankle cuff into a recess on said raised rear wall, said first surface being defined by an edge segment of said opening in said ankle cuff, said second surface being defined by a segment on said support head opposing said edge segment.

10. The improved combination according to claim 1, including a sole plate positioned between said ski boot and said ski, said heel holder being mounted on said sole plate and further including a front toe holder, said heel holder having said second means thereon engaging said raised rear wall of said lower shell of said ski boot and forming said second surface for said projection means.

11. The improved combination according to claim 10, wherein said second means engages, in addition to said raised rear wall of said lower shell, said ankle cuff to lock said ankle cuff to said lower shell.

12. The improved combination according to claim 1, including a support element fixed with respect to said ski and located adjacent the toe of said ski boot for limiting the forward extent of said pivotal movement of said ankle cuff.

13. The improved combination according to claim 12, including a front toe holder and wherein said support element consists of an extension which is secured to said front toe holder and terminates at the free end thereof in an insert member and wherein said ski boot has at least two spaced buckles thereon, said insert member being received in the space between said buckles.

14. The improved combination according to claim 13, wherein said boot buckles include adjustment means for permitting an adjustment of the position thereof relative to said ski boot to vary the spacing therebetween.

15. The improved combination according to claim 1, wherein said means includes a support member movably supported on said ski, and wherein said second surface is on said support member and is defined by a roller rotatably mounted on said support member.

* * * * *

UNITED STATES PATENT AND TRADEMARK OFFICE

CERTIFICATE OF CORRECTION

PATENT NO. : 4 133 119

DATED : January 9, 1979

INVENTOR(S) : Axel R. Kubelka

It is certified that error appears in the above-identified patent and that said Letters Patent are hereby corrected as shown below:

Column 6, line 24; change "15" to ---1---.

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*